US011613910B2

(12) United States Patent
Clifford

(10) Patent No.: US 11,613,910 B2
(45) Date of Patent: Mar. 28, 2023

(54) LOCK CYLINDERS AND CONTROL KEYS

(71) Applicant: Schlage Lock Company LLC, Carmel, IN (US)

(72) Inventor: Jason C. Clifford, Colorado Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 1002 days.

(21) Appl. No.: 16/399,307

(22) Filed: Apr. 30, 2019

(65) Prior Publication Data

US 2019/0257115 A1 Aug. 22, 2019

Related U.S. Application Data

(62) Division of application No. 15/366,633, filed on Dec. 1, 2016, now Pat. No. 10,273,717.

(60) Provisional application No. 62/261,512, filed on Dec. 1, 2015.

(51) Int. Cl.

| | |
|---|---|
| ***E05B 27/00*** | (2006.01) |
| ***E05B 19/00*** | (2006.01) |
| ***E05B 9/08*** | (2006.01) |

(52) U.S. Cl.

CPC ..... *E05B 27/0053* (2013.01); *E05B 9/086* (2013.01); *E05B 19/0041* (2013.01); *E05B 27/005* (2013.01); *E05B 27/0007* (2013.01)

(58) Field of Classification Search

CPC .. E05B 27/0053; E05B 9/086; E05B 19/0041; E05B 27/0007; E05B 27/005; Y10T 70/7463; Y10T 70/7469; Y10T 70/7475; Y10T 70/748; Y10T 70/7446; Y10T 70/7452

USPC ..... 70/352

See application file for complete search history.

(56) References Cited

U.S. PATENT DOCUMENTS

| | | | |
|---|---|---|---|
| RE31,910 | E | 6/1985 | Oliver |
| 5,176,015 | A | 1/1993 | Sussina |
| 5,421,179 | A | 6/1995 | Bergstrom |
| 5,715,717 | A | 2/1998 | Widen |
| 5,809,816 | A | 9/1998 | Widen |

(Continued)

OTHER PUBLICATIONS

Allegion; Schlage Everest Full Size Cylinder Service Manual; Copyright 2014 Allegion; 19 pages.

(Continued)

*Primary Examiner* — Suzanne L Barrett

(74) *Attorney, Agent, or Firm* — Taft Stettinius & Hollister LLP

(57) ABSTRACT

A system including a lock class having a plurality of lock families, with each lock family including a plurality of lock cylinders. Each of the lock families has a control pin location which is different from the control pin location of another of the lock families within the lock class. Each of the lock cylinders generally includes a shell, a plug rotatably mounted in the shell, and a control ring rotatably mounted on the plug at the control pin location of the lock family of which the lock cylinder is a member, and a control pin operable to selectively couple the plug with the control ring. Each lock family may be associated with a control key family. Each control key family may include a plurality of control keys, each of which may have a control bitting configured to urge control pins of the associated lock family to a coupling position.

22 Claims, 12 Drawing Sheets

(56) References Cited

U.S. PATENT DOCUMENTS

| | | | | |
|---|---|---|---|---|
| 5,813,260 | A | 9/1998 | Widen | |
| 5,943,890 | A * | 8/1999 | Field | E05B 27/0053 70/369 |
| 7,159,424 | B2 * | 1/2007 | Widen | E05B 27/0082 70/494 |
| 7,665,336 | B2 * | 2/2010 | Widen | E05B 27/0082 70/494 |
| 7,665,337 | B1 | 2/2010 | Widen | |
| 7,958,759 | B2 | 6/2011 | Herdman | |
| 8,186,194 | B2 | 5/2012 | Field et al. | |
| 8,205,473 | B2 * | 6/2012 | Widen | E05B 19/0029 70/405 |
| 8,479,545 | B2 | 7/2013 | Teixeira | |
| 9,127,480 | B2 | 9/2015 | Mathachan | |
| 9,587,415 | B2 | 3/2017 | Walls et al. | |
| 9,598,880 | B2 | 3/2017 | Walls et al. | |
| 10,273,717 | B2 * | 4/2019 | Clifford | E05B 27/005 |
| 10,808,421 | B2 * | 10/2020 | Clifford | E05B 27/0053 |
| 11,280,111 | B2 * | 3/2022 | Benzie | E05B 35/003 |
| 2002/0116968 | A1 | 8/2002 | Shvarts | |
| 2008/0223097 | A1 * | 9/2008 | Field | E05B 27/0053 70/494 |
| 2014/0216114 | A1 * | 8/2014 | Clifford | E05B 29/0066 70/344 |
| 2015/0225981 | A1 * | 8/2015 | Clifford | E05B 11/00 70/490 |
| 2015/0247343 | A1 | 9/2015 | Walls et al. | |

OTHER PUBLICATIONS

Allegion; Schlage Primus Service Manual; Copyright 2014 Allegion; 45 pages.

* cited by examiner

LOCK CYLINDERS AND CONTROL KEYS

CROSS-REFERENCE TO RELATED APPLICATIONS

This application is a divisional of U.S. patent application Ser. No. 15/366,633 filed Dec. 1, 2016 and issued as U.S. Pat. No. 10,273,717, which claims the benefit of U.S. Provisional Application Ser. No. 62/261,512 filed Dec. 1, 2015, the contents of each application hereby incorporated herein by reference in their entirety.

TECHNICAL FIELD

The present disclosure generally relates to lock cylinders, and more particularly but not exclusively relates to lock cylinders with interchangeable cores.

BACKGROUND

Certain locks include an interchangeable core or lock cylinder such that the cylinder can be removed from a lock housing without disassembling the lock assembly. In some systems, an entry or change key is utilized during normal locking and unlocking operations, and a control key is utilized to remove the cylinder from the housing. Some such systems have certain limitations and disadvantages. Therefore, a need remains for further improvements in systems and methods directed to lock cylinders having interchangeable cores.

SUMMARY

An exemplary system includes a lock class having a plurality of lock families, with each family including a plurality of lock cylinders. Each of the lock families has a control pin location that is different from the control pin location of another of the lock families within the lock class. Each of the lock cylinders generally includes a shell, a plug rotatably mounted in the shell, and a control ring rotatably mounted on the plug at the control pin location of the lock family of which the lock cylinder is a member, and a control pin operable to selectively couple the plug with the control ring. Each lock family may be associated with a control key family. Each control key family may include a plurality of control keys, each of which has a control bitting configured to urge control pins of the associated lock family to a coupling position. Further embodiments, forms, features, and aspects of the present application will become apparent from the description and figures provided herewith.

DETAILED DESCRIPTION OF ILLUSTRATIVE EMBODIMENTS

Figure 1:
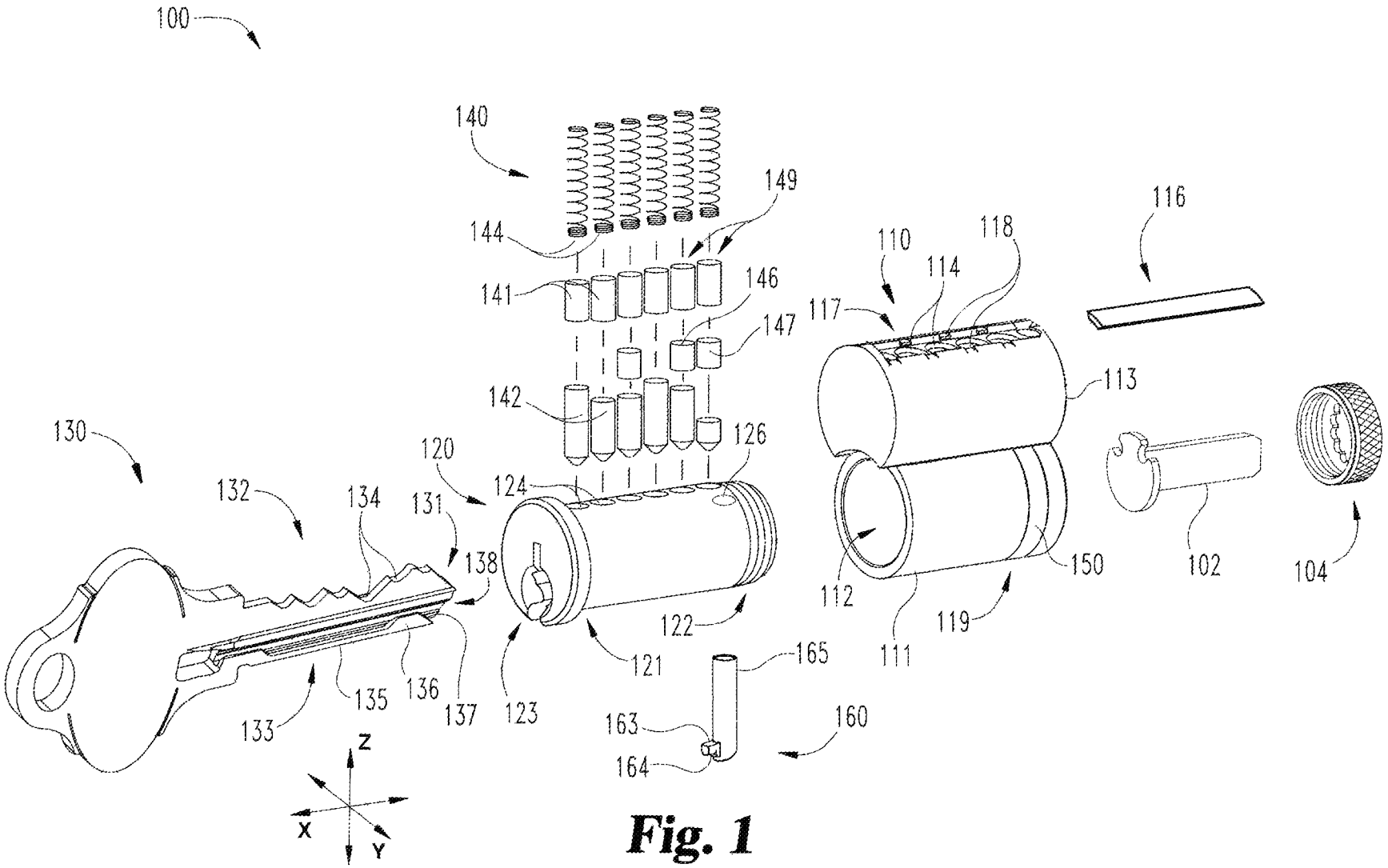
FIG. 1 is an exploded assembly illustration of a lock cylinder and key according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, illustrated therein is a lock core or lock cylinder 100 according to one embodiment which generally includes a shell 110 and a plug 120 mounted in the shell 110 and operable by a key 130. The lock cylinder 100 further includes a tumbler system 140 which permits rotation of the plug 120 with respect to the shell 110 upon insertion of the proper key 130. The lock cylinder 100 further includes a control ring 150 rotatably mounted on the plug 120, and a control pin 160 which is seated in the plug 120 and generally aligned with the control ring 150. As described in further detail below, the control ring 150 and the control pin 160 are configured to enable the cylinder 100 to be selectively retained within a housing. The cylinder 100 may further include a tailpiece 102 rotationally coupled with the plug 120 such as, for example, by a cap 104 engaged with a threaded distal end of the plug 120.

As used herein, the terms "longitudinal", "lateral" and "transverse" are used to denote motion or spacing along or substantially along three mutually perpendicular axes. In the coordinate plane illustrated in FIG. 1, the X-axis defines the longitudinal directions (including a proximal direction and a distal direction), the Y-axis defines the lateral directions, and the Z-axis defines the transverse directions. These terms are used for ease of convenience and description, and are without regard to the particular orientation of the system with respect to the environment. For example, descriptions that reference a longitudinal direction may be equally applicable to a vertical direction, a horizontal direction, or an off-axis orientation with respect to the environment. Additionally, motion or spacing along one direction need not preclude motion or spacing along another of the directions. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

The shell 110 generally includes a body portion 111 defining a longitudinally-extending chamber 112 in which the plug 120 is positioned, and a tower 113 defining a plurality of shell tumbler shafts 114 configured to receive a portion of the tumbler system 140. The shell 110 may further include a cover plate 116 which covers the shell tumbler shafts 114 and retains the tumbler system 140 within the assembled cylinder 100. For example, the cover plate 116 may be seated in a channel 117 connected to the shell tumbler shafts 114, and tabs 118 may be provided to retain the cover plate 116 in the channel 117. The shell 110 also includes a control ring channel 119 sized and configured to receive the control ring 150.

Figure 3:
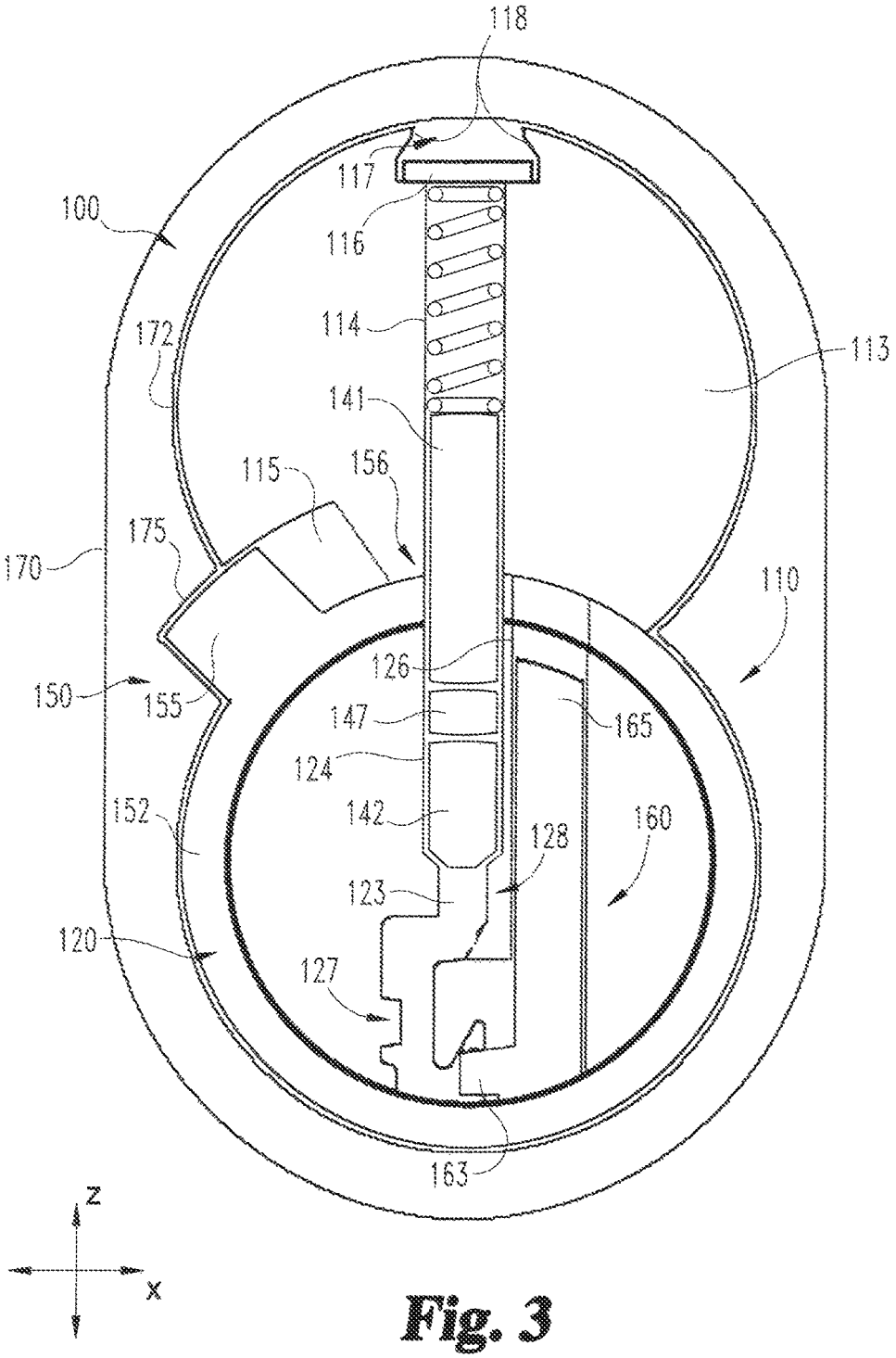
FIG. 3 is a cross-sectional illustration of the lock cylinder illustrated in FIG. 1 with a control ring in a holding position.
Figure 4:
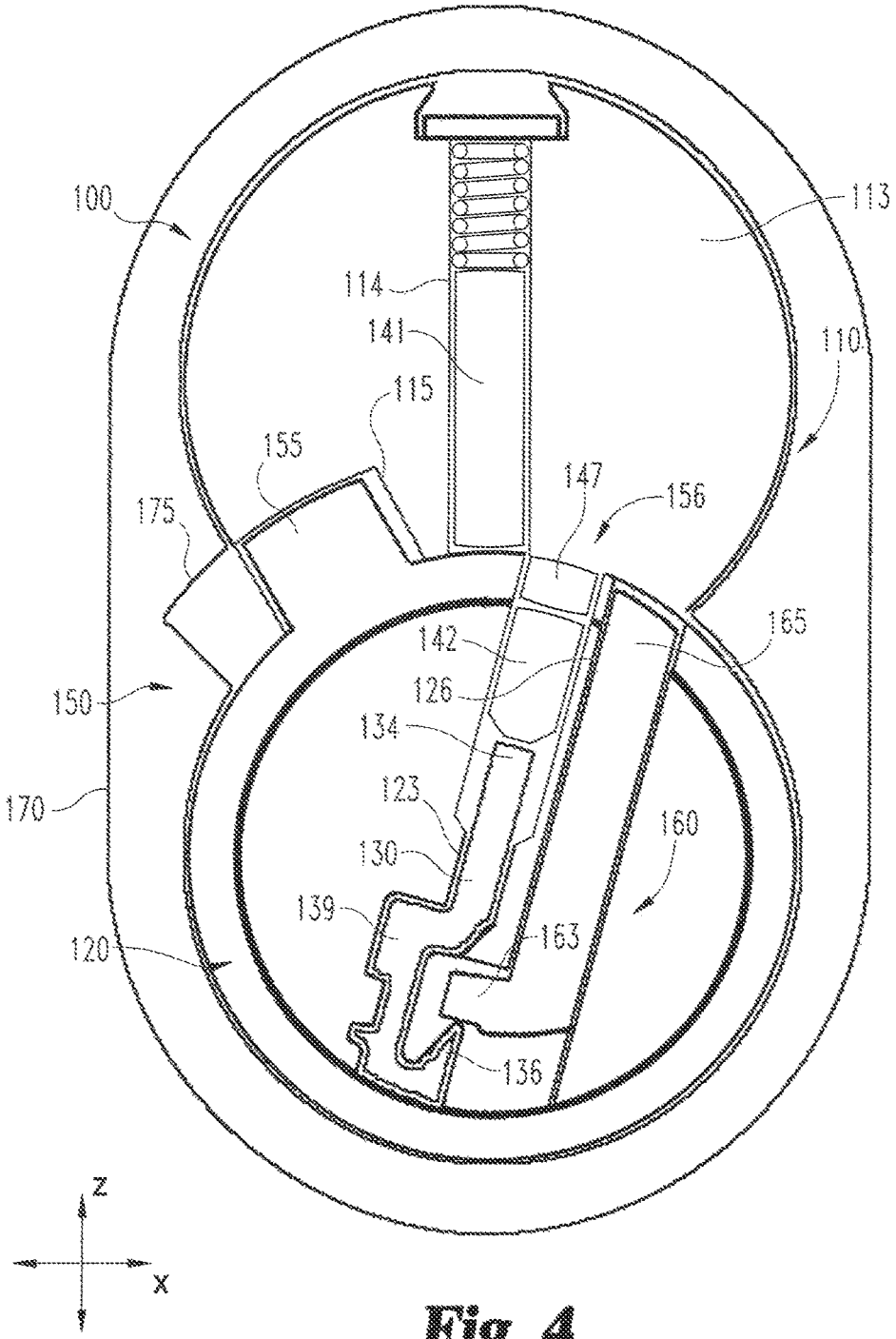
FIG. 4 is a cross-sectional illustration of the lock cylinder illustrated in FIG. 1 with the control ring in a releasing position.

The tower 113 may provide the shell 110 with a standard footprint or cross-section such that the cylinder 100 can be installed into an existing cylinder housing 170 (FIGS. 3 and 4). In the illustrated embodiment, the tower 113 is configured such that the cylinder 100 is a small format interchangeable core (SFIC) lock cylinder. However, it is also contemplated that the shell 110 may be configured such that the cylinder 100 is an interchangeable core cylinder of another configuration or format such as, for example, full size, large format, mortise, and/or rim, the details of which would be understood by those having skill in the art to which the invention relates.

The plug 120 is disposed within the chamber 112 and includes a proximal end 121 and a distal end 122 that is longitudinally offset from the proximal end 121. The plug 120 defines a keyway 123 which extends longitudinally from the proximal end 121 toward the distal end 122. The plug 120 also defines a plurality of plug tumbler shafts 124 which are sized and configured to receive a portion of the tumbler system 140. When the plug 120 is seated in the shell 110 and positioned in a home or unrotated position, the plug tumbler shafts 124 are generally aligned with the shell tumbler shafts 114. The plug 120 further defines a control pin cavity 126 sized and configured to receive the control pin 160.

Figure 2:
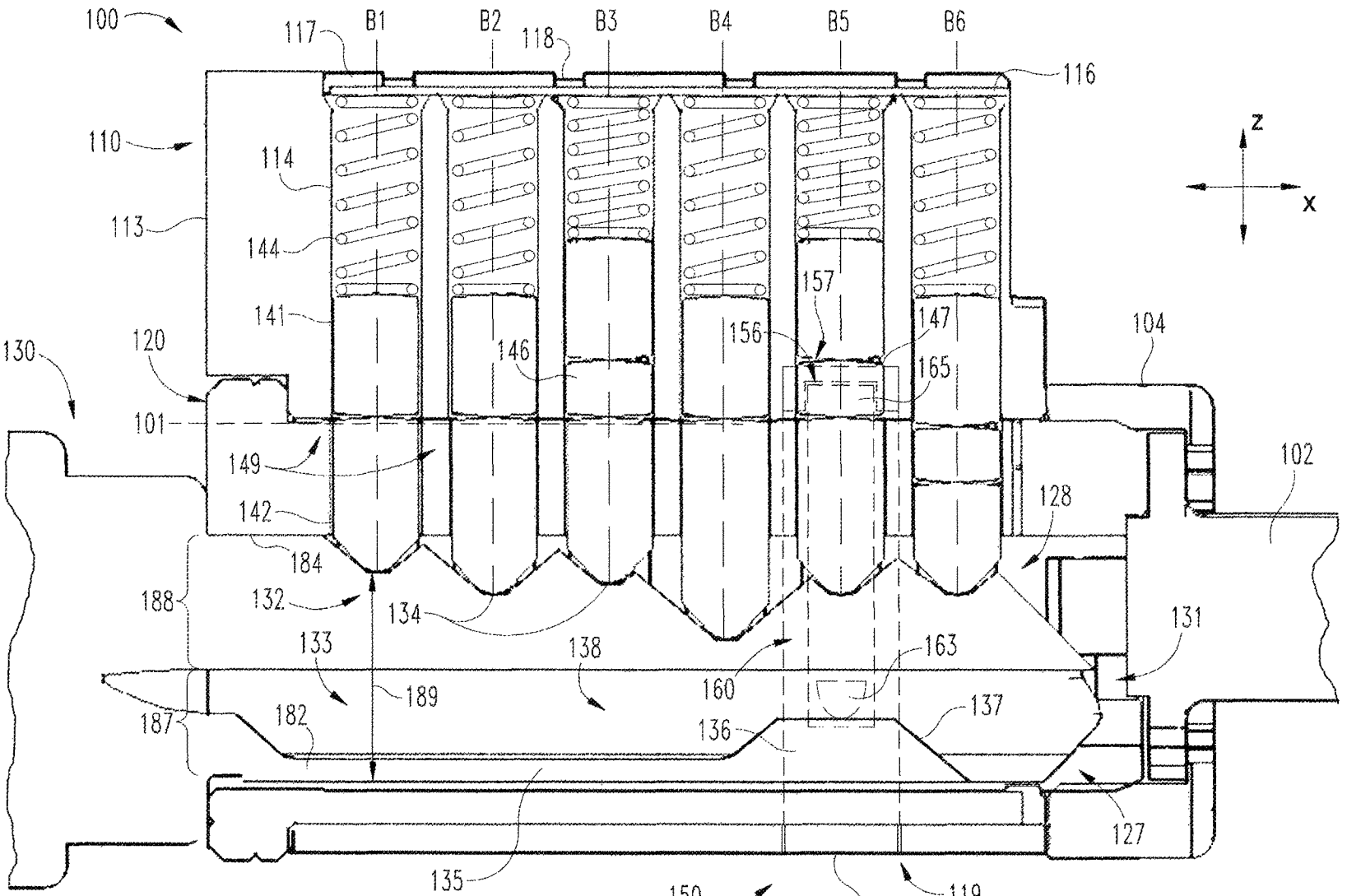
FIG. 2 is a cross-sectional illustration of the lock cylinder and key illustrated in FIG. 1.

With reference to FIG. 2, the key 130 includes a longitudinally extending shank 180 which terminates in a tip 131. The shank of the key 130 includes an edge cut 132 formed in the narrow edge of the key 130, and a side surface cut 133 formed in the broad side surface of the key 130. The edge cut 132 includes a plurality of edge cut bittings 134, each of which is formed at one of the bitting positions B1-B6 of the key 130. The bittings 134 provide the key 130 with a bitting code which is defined by the set of root depths at the bitting positions B1-B6.

The shank 180 includes a base or bottom edge 182, a top edge 184 defined by the edge cut 132, a lower first section 187 including the bottom edge 182, and an upper second section 188 including the top edge 184. The side surface cut 133 is formed in the lower first section 187, and the edge cut 132 is formed in the upper second section 188. The root depth 189 of the shank at any point along the length thereof corresponds to the transverse distance between the bottom edge 182 and the top edge 184. The keyway 123 includes a lower first region 127 and an upper second region 128, which respectively receive the lower first section 187 and the upper second section 188 of the shank 180. The second region 128 is defined between and connected to the first region 127 and the plug tumbler shafts 124.

The illustrated key 130 is configured as a control key, and the surface cut 133 includes a control bitting 136. While other forms are contemplated, the illustrated surface cut 133 is of the type commonly known as a "side-milling", and defines the side-milled control bitting 136 and an undercut 138. The surface cut 133 may also define a ledge 135 such that the undercut 138 forms a groove in the broad side surface of the key 130. In other embodiments, the ledge 135 may be eliminated. In either case, the surface cut 133 at least partially defines a cross-sectional profile 139 of the key 130. It is to be appreciated that the cross-sectional profile 139 (formed in the Y-Z plane) is distinct from the bitting code of the key 130, which is defined by the edge cut 132 (formed in the X-Z plane). The exemplary control bitting 136 is provided in the form of a ridge, the distal end of which terminates in a ramp 137. As described in further detail below, the edge cut bittings 134 are configured to adjust the position of the tumbler system 140, and the control bitting 136 is configured to adjust the position of the control pin 160. While other forms are contemplated, the surface cut 133 generally defines the control bitting 136. That is to say that while the surface cut 133 may include the groove and the ledge 135, the remaining portions of the surface cut 133 do not engage the tumbler system 140 or the control pin 160 when the key 130 is inserted into the plug 120.

The illustrated tumbler system 140 includes a plurality of tumbler sets 149, each of which includes a driving pin 141 seated in the shell 110, and a driven pin 142 seated in the plug 120. More specifically, each driving pin 141 is received in one of the shell tumbler shafts 114, and each of the driven pins 142 is seated in one of the plug tumbler shafts 124. One or more of the tumbler sets 149 may further include one or more master pins 146 such that the lock cylinder 100 is operable by more than one bitting code. In certain forms, one or more of the tumbler sets 149 may further include a dummy pin 147, the function of which is described below. The tumbler system 140 further includes a plurality of biasing members in the form of springs 144. Each of the springs 144 is positioned in one of the shell tumbler shafts 114 between the cover plate 116 and the corresponding driving pin 141, thereby urging the driven pins 142 into the keyway 123.

The tumbler system 140 is configured to selectively prevent rotation of the plug 120 with respect to the shell 110. The tumbler system 140 is biased to a locking state by the springs 144, and is movable to an unlocking state upon insertion of a proper key 130. In the locking state, such as when no key is inserted, one of the driving pins 141 in each of the tumbler sets 149 crosses a shear line 101 defined between the plug 120 and the shell 110. With the driving pin 141 positioned partially in the shell 110 and partially in the plug 120, the driving pin 141 prevents rotation of the plug 120.

As the key 130 is inserted, the edge cut 132 engages the driven pins 142, thereby adjusting the position of each tumbler set 149. When the proper key 130 is fully inserted, each of the driven pins 142 is engaged with a corresponding edge cut bitting 134, and each of the driving pins 141 is urged into the corresponding shell tumbler shaft 114 such that a pin interface in each tumbler set 149 becomes aligned with the shear line 101. In other words, in the unlocking state, the driving pins 141, the driven pins 142, and the master pins 146 do not cross the shear line 101. With each of the driving pins 141, the driven pins 142, and the master pins 146 positioned substantially entirely within either the shell 110 or the plug 120, rotation of the plug 120 is not prevented.

The term "substantially" as used herein may be applied to modify a quantitative representation which could permissibly vary without resulting in a change in the basic function to which it is related. For example, the pins 141, 142, 146 are described above as being positioned substantially entirely within either the shell 110 or the plug 120 when the tumbler system 140 is positioned in the unlocking state. It is to be understood, however, that one or more of the pins 141, 142, 146 may permissibly impinge slightly into the other of the shell 110 and the plug 120 so long as the plug 120 remains free to rotate with respect to the shell 110. For example, the pins 141, 142, 146 may include beveled ends which allow for some slight misalignment with the shear line 101.

While the exemplary tumbler system 140 includes a plurality of sets of pin tumblers, it is also contemplated one or more of the tumbler sets 149 may be replaced by another form or configuration of tumbler such as, for example, a wafer tumbler or a rotary disc tumbler. In such forms, the tumbler system 140 may nevertheless be biased to a locking state and movable to an unlocking state upon insertion of a proper key 130.

With reference to FIGS. 3 and 4, the control ring 150 generally includes an annular portion 152 and a control lug 155 which extends radially outward from the annular portion 152. The annular portion 152 defines a primary opening 153 configured to receive the plug 120, and a secondary opening 156 configured to receive a portion of the control pin 160. The primary opening 153 extends through the control ring 150 in the longitudinal direction, and the secondary opening 156 extends outward from the primary opening 153. The control ring 150 may also define a dummy pin opening 157 configured to receive the dummy pin 147. The control ring 150 is rotatably mounted on the plug 120 such that the secondary opening 156 is longitudinally aligned with the control pin cavity 126. In the illustrated embodiment, the annular portion 152 defines a complete circle which circumferentially surrounds the plug 120. In other embodiments, the annular portion 152 need not define a complete circle, but may instead be configured to only partially surround the plug 120.

While other forms are contemplated, in the illustrated embodiment, the lock cylinder 100 is configured as a small format interchangeable core (SFIC) cylinder including an SFIC tower 113. The tower 113 includes a lateral slot 115 sized and configured to receive the control lug 155, and a lateral channel 119 sized and configured to receive the annular portion 152. As shown in FIGS. 3 and 4, the cylinder 100 is configured for mounting in an SFIC housing 170 which may, for example, be installed in or defined by a handle, knob, or deadbolt housing. The housing 170 includes a housing chamber 172 configured to receive the shell 110, and a slot 175 aligned with the control lug slot 115.

When the cylinder 100 is installed in the housing 170, the control ring 150 is operable to selectively retain the cylinder 100 in the housing 170. As described in further detail below, the control ring 150 is rotatable between a holding position and a releasing position, and the control pin 160 is operable to rotate the control ring 150 upon insertion of a proper key 130. In the holding position (FIG. 3), the control lug 155 is positioned at least partially in the housing slot 175, thereby preventing longitudinal movement of the cylinder 100 within the housing 170. In the releasing position (FIG. 4), the control lug 155 is positioned in the control lug slot 115 and does not prevent longitudinal movement of the cylinder 100.

The control pin 160 is seated in the control pin cavity 126 and generally includes an arm 163 extending into the keyway 123, and a tip 165 positioned proximate the secondary opening 156. The control pin 160 is configured to selectively couple the plug 120 with the control ring 150, and is operable in both a decoupling position and a coupling position. In the decoupling position (FIG. 3), the tip 165 does not extend into the control ring secondary opening 156, and the plug 120 is rotationally decoupled from the control ring 150. In the coupling position (FIG. 4), the tip 165 extends into the control ring secondary opening 156, and the plug 120 is rotationally coupled with the control ring 150.

The arm 163 is configured to engage the surface cut 133 upon insertion of the control key 130. More specifically, when the key 130 is inserted into the keyway 123, the arm 163 engages the ramp 137, thereby adjusting the position of the control pin 160. The arm 163 may include a tapered or curved engagement surface 164 to facilitate a smooth engagement between the arm 163 and the ramp 137. When the key 130 is fully inserted, the arm 163 is engaged with the control bitting 136, which in turn retains the control pin 160 in the coupling position.

As noted above, when a proper key, such as the control key 130, is inserted into the keyway, the tumbler system 140 is positioned in the unlocking state. In the unlocking state, each of the driving pins 141, the driven pins 142, and the master pins 146 are positioned substantially entirely within either the shell 110 or the plug 120. Additionally, the dummy pin 147 is positioned substantially entirely within the dummy pin opening 157 such that the plug 120 is rotatable with respect to the control ring 150, and the control ring 150 is rotatable with respect to the shell 110. If the inserted key is a control key 130, the control pin 160 is positioned in the coupling position and rotationally couples the plug 120 and the control ring 150 to one another. If the key 130 is subsequently rotated, the control ring 150 rotates from the holding position (FIG. 3) to the releasing position (FIG. 4). In the holding position, the control lug 155 is not aligned with the tower 113, but is instead positioned at least partially in the housing slot 175. In the releasing position, the control lug 155 is aligned with the tower 113 and is not positioned in the housing slot 175. In other words, in the releasing position, the control lug 155 is positioned substantially entirely within the footprint of the tower 113.

While the illustrated key is a control key 130 which includes the control bitting 136, it is to be appreciated that if a key does not include a control bitting 136 of the appropriate configuration, the key may still operate the lock cylinder 100 in a normal fashion. In other words, a change key which includes the appropriate edge cut 132, but which does not include the correct surface cut 133, may still be capable of rotating the plug 120 to transition the cylinder 100 between its locked and unlocked states.

In the illustrated embodiment, the tumbler system 140 includes the dummy pin 147, and the control ring 150 includes the dummy pin opening 157. In other embodiments, the control ring 150 may instead include a narrow portion having a reduced longitudinal thickness. The narrow portion may partially define one or more of the shell tumbler shafts 114, and may be formed along a geometric sector of the annular portion 152 such that the tumbler system 140 does not interfere with rotation of the control ring 150.

Figure 5:
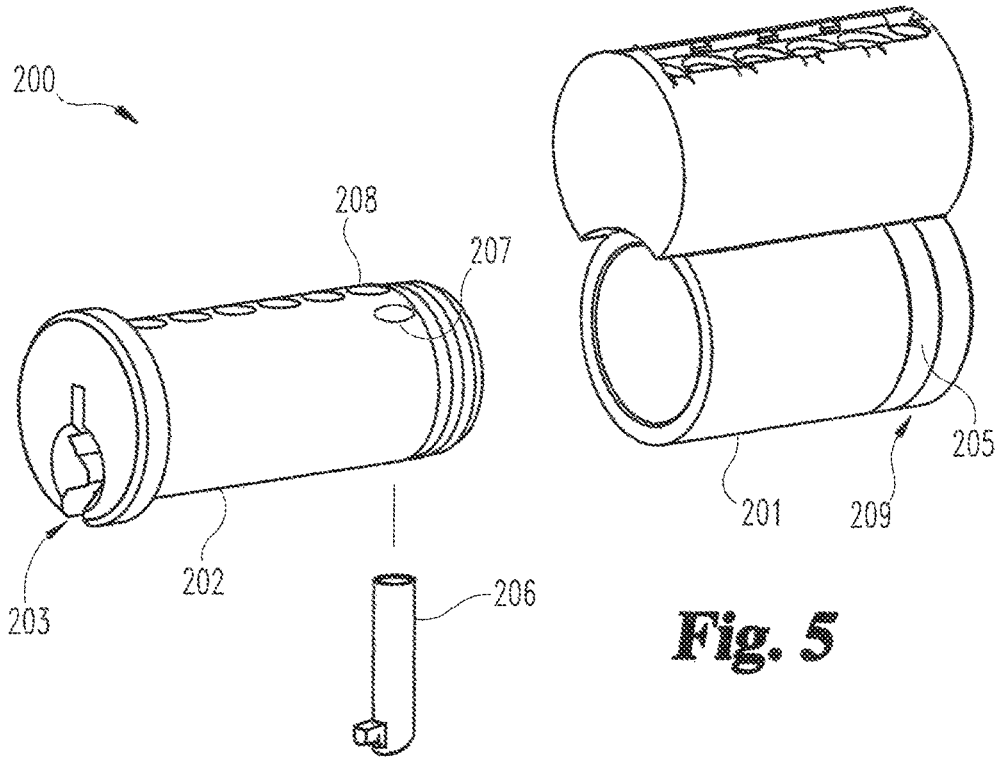
FIG. 5 is an exploded assembly illustration of a lock family blank according to one embodiment.

With reference to FIG. 5, an illustrative lock family blank 200 includes a shell 201, a plug 202 rotatably seated in the shell 201, a control ring 205 rotatably mounted on the plug 202, and a control pin 206 which selectively couples the plug 202 and the control ring 205. The plug defines a keyway 203, a control pin cavity 207 in which the control pin 206 is seated, and a plurality of plug tumbler shafts 208 configured to receive a portion of a tumbler system. The shell 201 defines a channel 209 sized and configured to receive the annular portion of the control ring 205. The tower of the shell 201 may define a slot sized and configured to receive the locking lug of the control ring 205 such as, for example, as described above with reference to FIGS. 3 and 4. The lock family blank 200 may be converted to a functioning lock cylinder such as the lock cylinder 100 by installing a tumbler system associated with a particular lock species.

Figure 6:
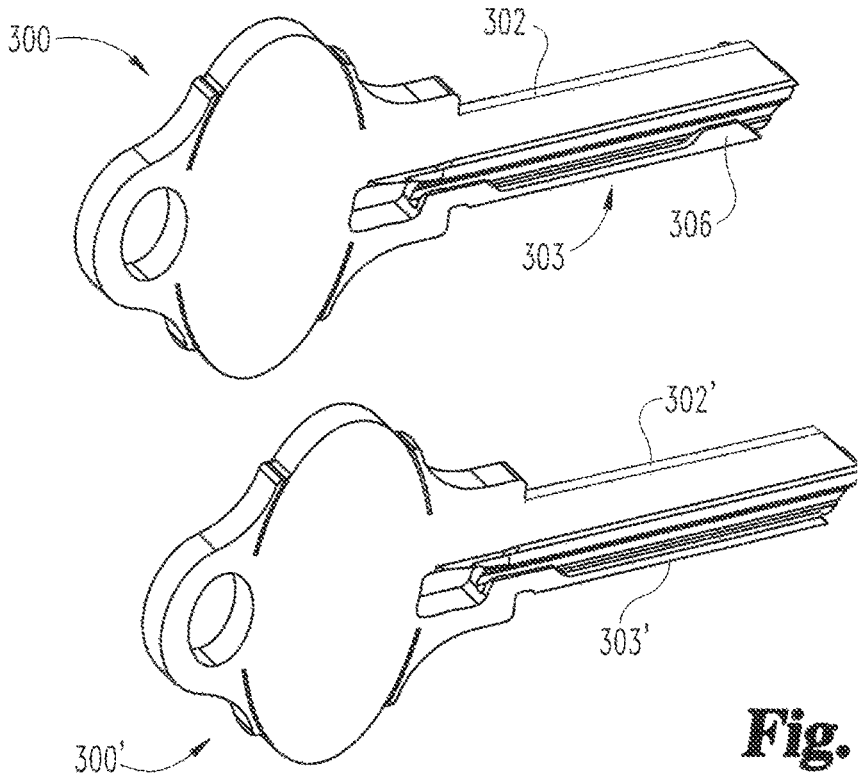
FIG. 6 is an illustration of a control key blank and a change key blank according to one embodiment.

With additional reference to FIG. 6, an illustrative control key family blank 300 and change key family blank 300' are associated and configured for use with the lock family blank 200. The control key family blank 300 includes a flat or uncut edge 302 and a surface cut 303 which at least partially defines a cross-sectional profile 309 of the control key family blank 300. The cross-sectional profile 309 corresponds to the keyway profile of the keyway 203 of the associated lock family blank 200 such that the keyway 203 is operable to receive the control key family blank 300. The surface cut 303 also defines a control bitting 306 at a control bitting location corresponding to the control pin location of the associated lock family blank 200. The change key family blank 300' is substantially similar to the control key family blank 300, but does not include the control bitting 306. As such, the change key family blank 300' is not operable to move the control pin 206 to the coupling position.

Figure 7:
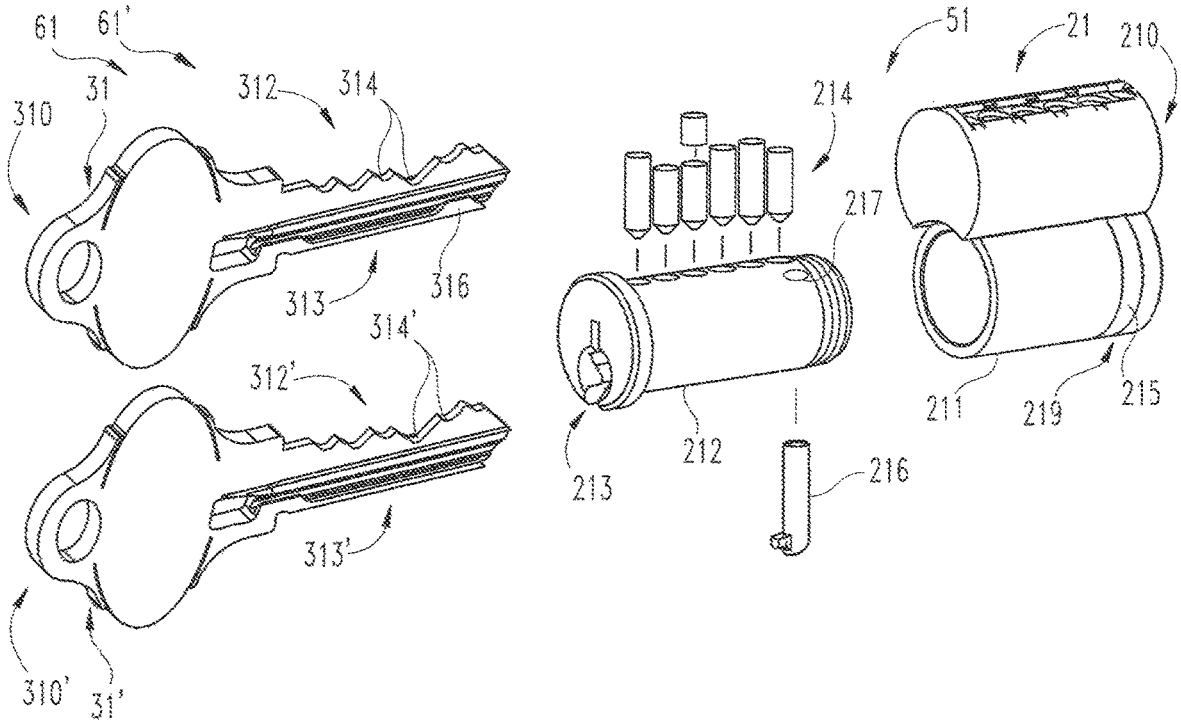
FIG. 7 is an illustration of a control key family, change key family, and lock family according to one embodiment.
Figure 7:
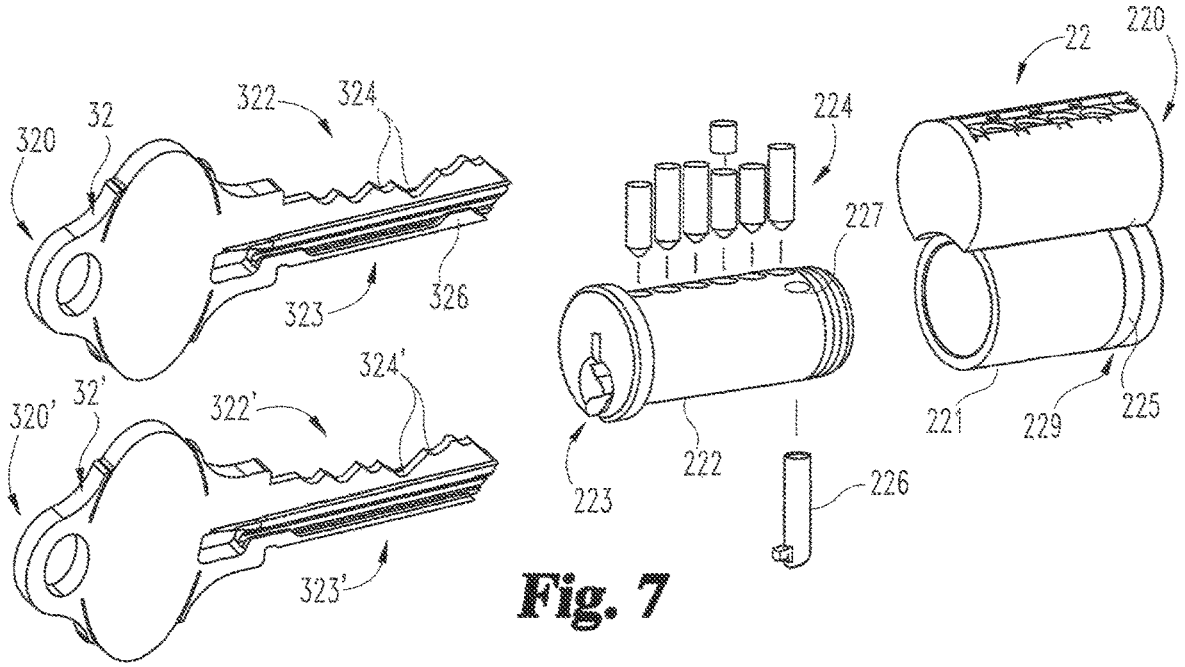

With further reference to FIG. 7, an illustrative lock family 51 includes a plurality of lock species 21, 22, each including at least one lock cylinder 210, 220. Each of the lock cylinders 210, 220 may be formed from one of the lock family blanks 200. The lock family 51 is associated with a control key family 61 formed from the control key family blanks 300, and a change key family 61' formed from the change key family blanks 300'. Each of the lock species 21, 22 is associated with a control key species 31, 32 and a change key species 31', 32'. Each of the control key species 31, 32 includes at least one control key 310, 320, and each of the change key species 31', 32' includes at least one change key 310' 320'. In the interest of conciseness, the following description is focused primarily on the lock cylinder 210, the control key 310, and the change key 310'. It is to be appreciated that such descriptions may be equally applicable to other members of the lock family 51, the control key family 61, and the change key family 61'.

The lock cylinder 210 is formed in part by a lock family blank 200, and similar reference characters are used to indicate similar elements and features. The lock cylinder 210 also includes a tumbler system 214 which may include driven pins and optionally master pins and/or dummy pins, as described above with reference to FIGS. 1-4. While the driving pins and springs are not illustrated, it is to be appreciated that these elements may nevertheless be present.

The control key 310 includes an edge cut 312 which provides the control key 310 with a bitting code corresponding to the tumbler system 214 of the associated lock cylinder 210. The control key 310 also includes the control bitting 316. The control key 310 is thus configured to move the tumbler system 214 to the unlocking state, and to move the control pin 216 to the coupling position. As such, the control key 310 is operable to move the control ring 215 to the releasing state such that the cylinder 210 can be removed from a cylinder housing.

The change key 310' similarly includes an edge cut 312' which provides the change key 310' with a bitting code corresponding to the tumbler system 214 of the associated lock cylinder 210. The change key 310' can thus move the tumbler system 214 to the unlocking state such that the plug 212 can be rotated. Due to the fact that the change key 310' lacks a control bitting, the change key 310' is not able to move the control pin 206 to the coupling position, and cannot be used to remove the cylinder 210 from the cylinder housing.

In certain forms, the control key edge cut 312 may be identical to the change key edge cut 312'. In other embodiments, the control key edge cut 312 may be different from the change key edge cut 312' such as, for example, in embodiments in which the tumbler system 214 includes one or more master pins. Furthermore, while the illustrated cylinder 210 is associated with a single control key 310 and a single change key 310', it is also contemplated that the cylinder 210 may be operated by a plurality of control keys 310 and/or a plurality of change keys 310', each of which may have identical or varying edge cuts 312, 312'.

By appropriately selecting the length of pins in the tumbler systems 214, 224, the lock cylinders 210, 220 of each of the lock species 21, 22 may be operable by a unique set of bitting codes. In certain embodiments, the set of bitting codes of two or more of the lock species 21, 22 in the lock family 51 may overlap. For example, the master pins in the tumbler systems 214, 224 may be sized and configured such that the control key 310 can remove each of the cylinders 210, 220 from a core housing.

Due to the fact that each of the control keys 310, 320 is formed from the same control key family blank 300, a single set of control key family blanks 300 can be provided for the entire lock family 51. A control key 310 can then be formed from the control key family blank 300 by forming an edge cut 312 corresponding to the bitting code selected for the associated lock species 21, such that the control key 310 is operable to remove a lock cylinder 210 of the associated lock species 21 from a cylinder housing.

Figure 8:
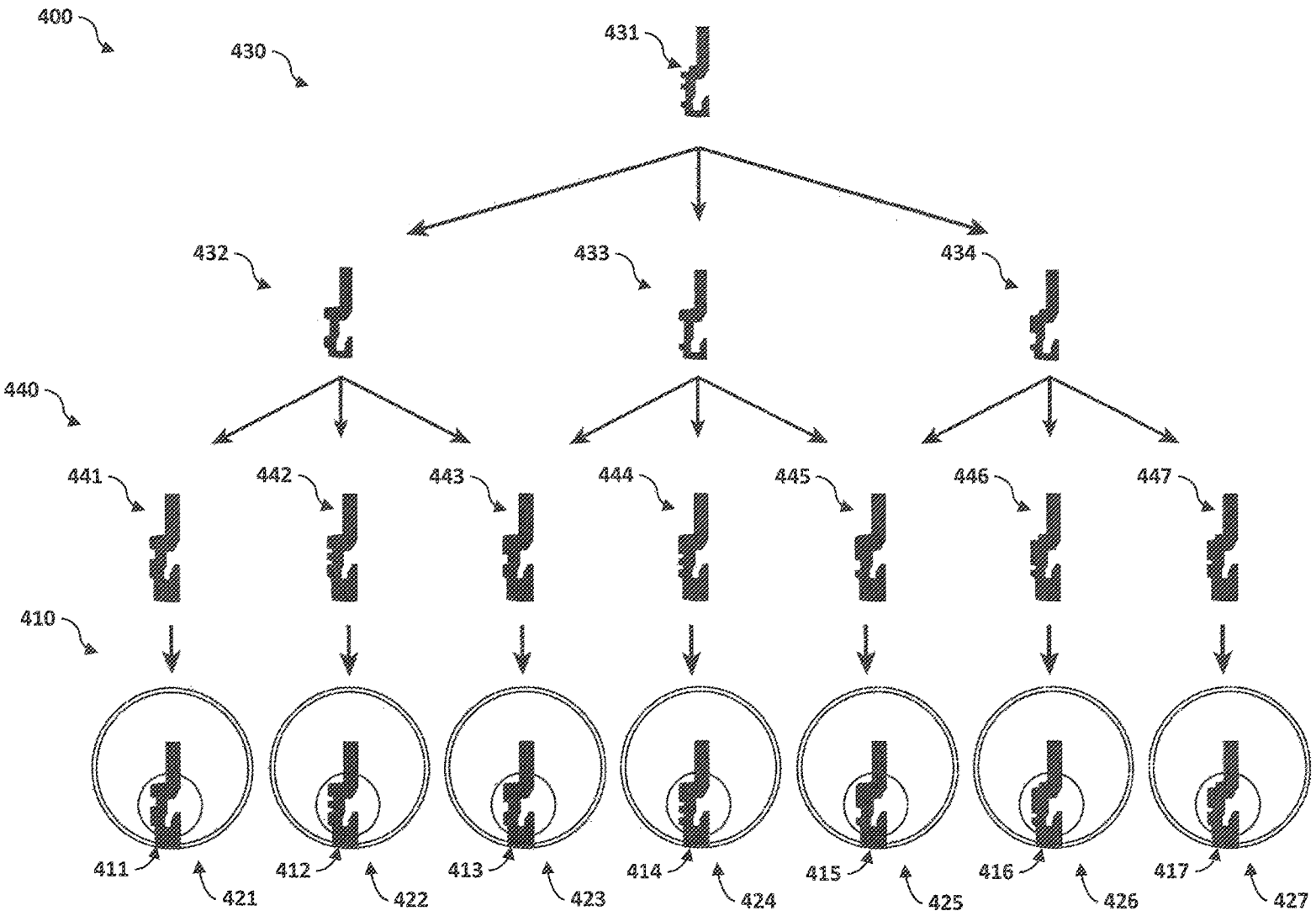
FIG. 8 is an illustration of cross-sectional key profiles and keyway profiles according to one embodiment.

FIG. 8 depicts an exemplary system 400 which includes a plug set 410 having a plurality of plugs 411-417 defining keyways of varying keyway profiles 421-427, and a cross-sectional key profile set 430 defining a plurality of cross-sectional key profiles 431-434 and 441-447. The plugs 411-417 may, for example, be utilized in conjunction with one of the previously-described lock cylinders such that the keyways of those plugs define one of the depicted keyway profiles 421-427. The cross-sectional key profile set 430 includes a plurality of unique cross-sectional key profiles, including a grandmaster cross-sectional profile 431, a plurality of master cross-sectional profiles 432-434, and a base cross-sectional profile set 440 having a plurality of base cross-sectional profiles 441-447.

Each of the keyway profiles 421-427 is configured to permit entry of a key having an appropriate cross-sectional profile, and to prevent an inappropriately-shaped key from being inserted into the keyway. Each of the cross-sectional profiles in the profile set 430 is configured to permit a key having the cross-sectional profile to be inserted into at least one member of the plug set 410, and may be configured to permit the key to be inserted into multiple members of the plug set 410. For example, keys having the grandmaster cross-sectional profile 431 can be inserted into any plug in the plug set 410. Keys having one of the master cross-sectional profiles 432-434 can be inserted into only a subset of the plugs in the illustrated plug set 410. For example, a key having the master cross-sectional profile 432 can be inserted into a subset including the plugs 411-413, but cannot be inserted into the remaining plugs 414-417. Keys having one of the base cross-sectional profiles 441-447 can be inserted into only one of plugs in the plug set 410. For example, a key having the base cross-sectional profile 441 can be inserted into one of the plugs 411, but not into the remaining plugs 412-417.

Similarly, the keyway profiles 421-427 may be configured to accept keys having different cross-sectional profiles selected from the cross-sectional profile set 430. For example, while one of the keyway profiles 423 can accept keys which have either a first master cross-sectional profile 432 or a second master cross-sectional profile 433, another of the keyway profiles 424 can accept a key having the second master cross-sectional profile 433, but not a key having the first master cross-sectional profile 432.

Figure 9:
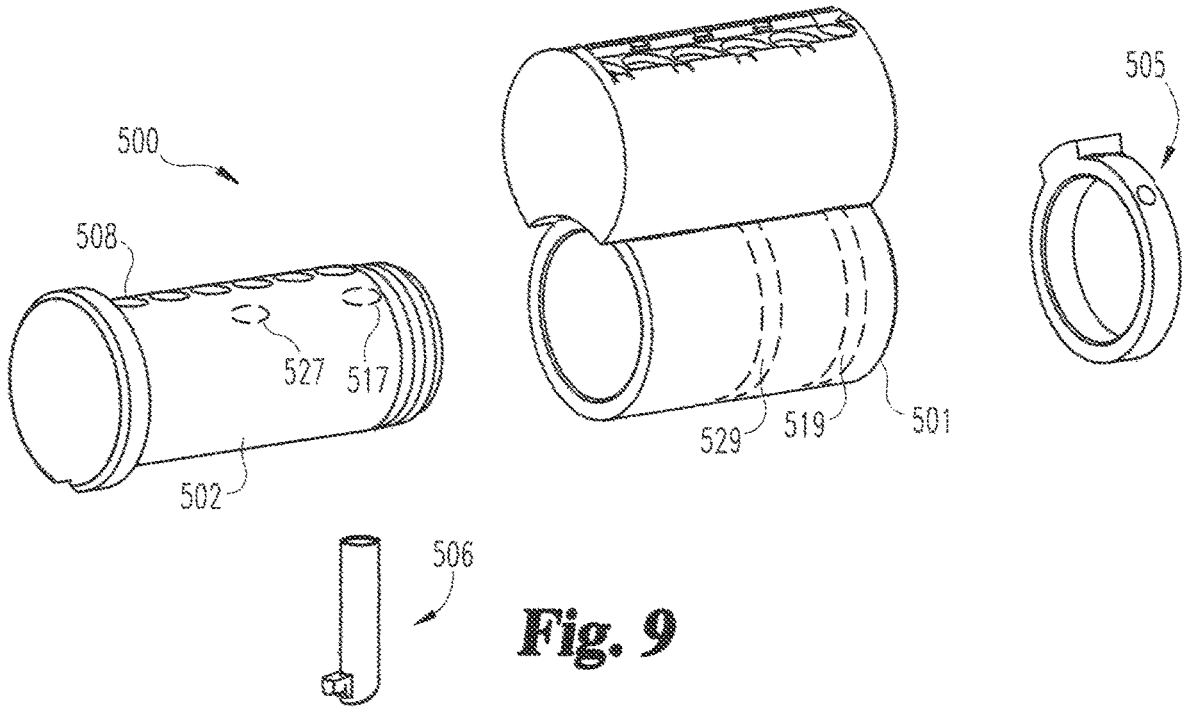
FIG. 9 is an illustration of a lock cylinder master blank according to one embodiment.

With reference to FIG. 9, a lock cylinder master blank 500 includes a shell 501, a plug 502 rotatably seated in the shell 501, a control ring 505 configured to be rotatably mounted on the plug 502, and a control pin 506 operable to selectively couple the plug 502 with the control ring 505. The plug 502 may define a plurality of plug tumbler shafts 508 configured to receive a portion of a tumbler system, but does not necessarily include a keyway or a control pin cavity. Similarly, while the shell 501 may include shell tumbler shafts, it does not necessarily include a channel for receiving the control ring 505. As described in further detail below, the cylinder master blank 500 may be utilized to create a plurality of lock cylinder families, each of which has a unique lock family blank similar to the above-described lock family blank 200.

Figure 10:
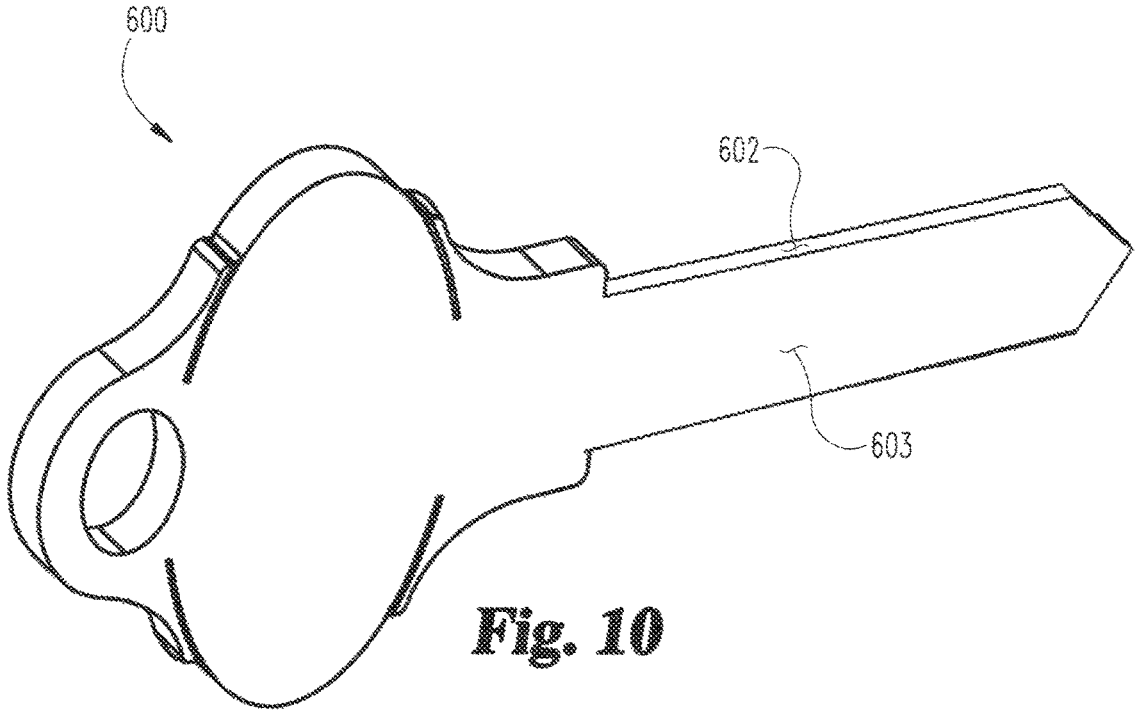
FIG. 10 is an illustration of a key master blank according to one embodiment.

With reference to FIG. 10, a key master blank 600 includes an uncut edge 602 and an uncut side surface 603. The root depth (or edge-to-edge dimension) of the key master blank 600 may correspond to the greatest root depth available in a locking system with which the key master blank 600 is associated. In such forms, the key master blank 600 may be provided with an edge cut corresponding to the bitting code of any tumbler system usable with the locking system such as, for example, by milling or machining the uncut edge 602. Similarly, the width (or surface-to-surface dimension) of the key master blank 600 may correspond to the greatest thickness of a key profile in a system such as the above-described system 400. In such embodiments, the key master blank 600 can be milled or machined to define any of the cross-sectional profiles in the profile set 430.

Figure 11:
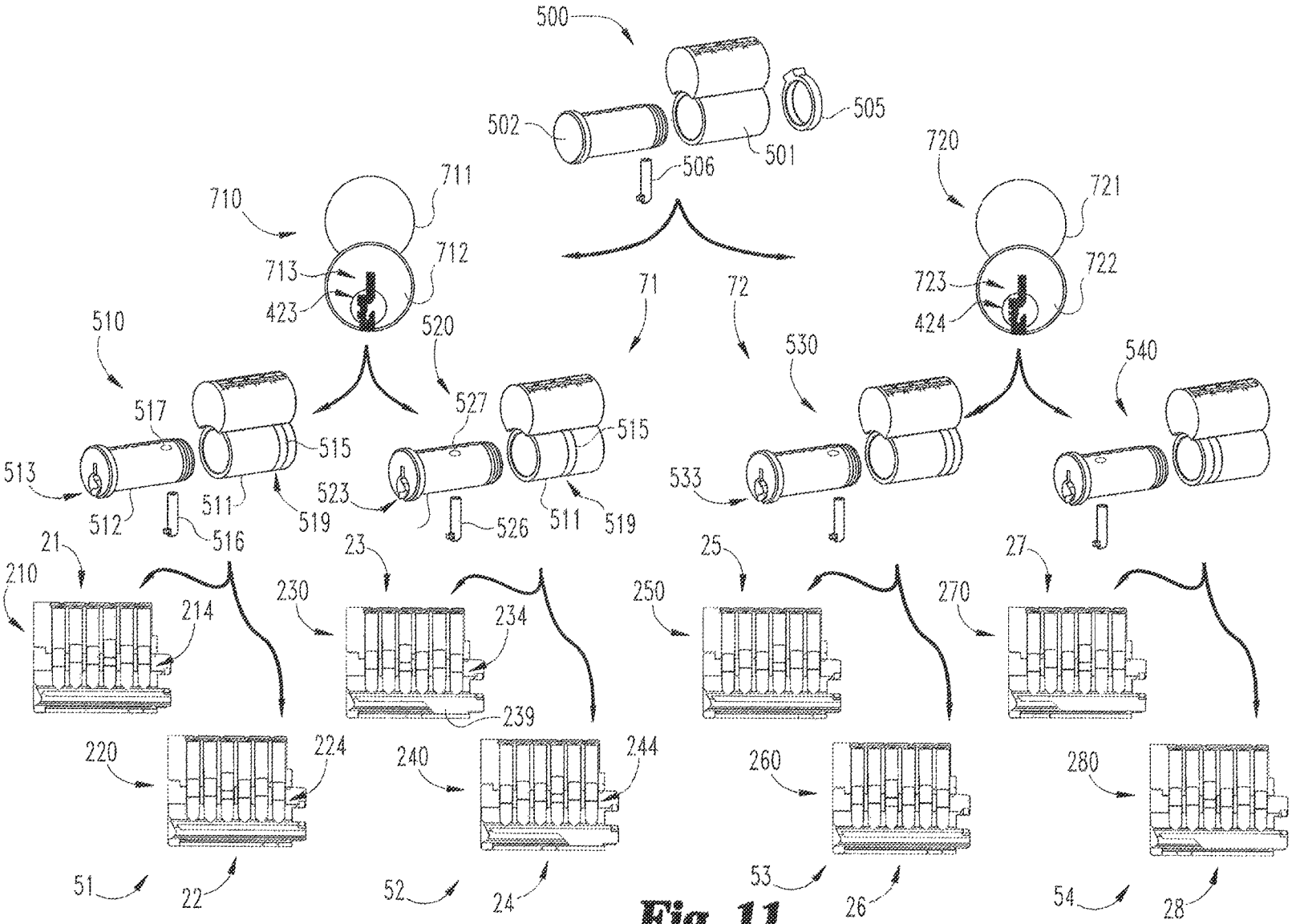
FIG. 11 is an illustration of a lock cylinder line according to one embodiment.
Figure 12:
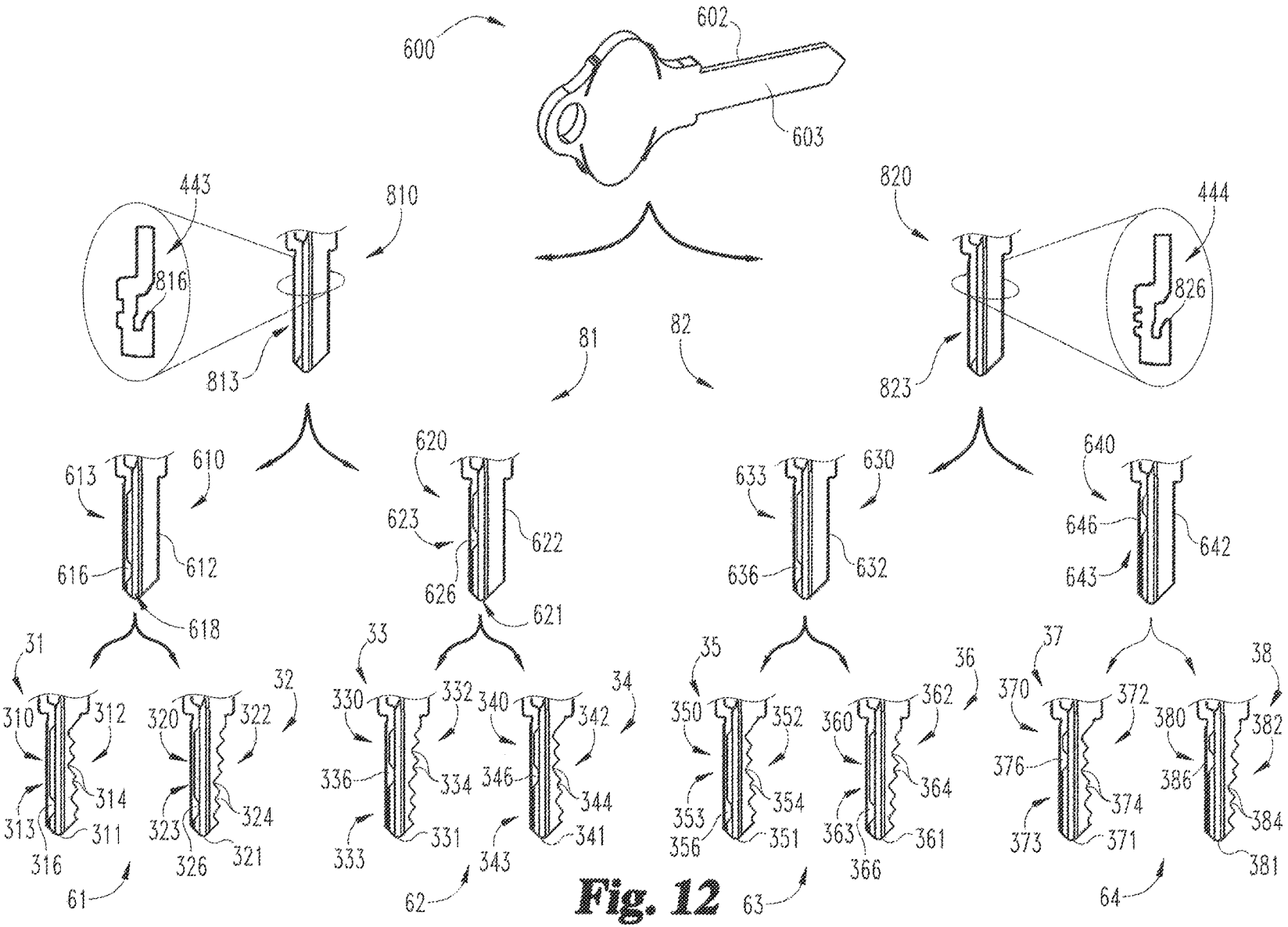
FIG. 12 is an illustration of a key line according to one embodiment.

With additional reference to FIGS. 11 and 12, the cylinder master blank 500 may be utilized to create a plurality of lock families 51, 52, 53, 54, and the key master blank 600 may be utilized to create a plurality of control key families 61, 62, 63, 64, each of which is associated with a corresponding lock family 51, 52, 53, 54. More specifically, the cylinder master blank 500 may be utilized to create a lock family blank 510, 520, 530, 540 for each of the lock families 51, 52, 53, 54, and the key master blank 600 may be utilized to create a control key family blank 610, 620, 630, 640 for each of the control key families 61, 62, 63, 64. In FIGS. 11 and 12, each of the lock family blanks is substantially similar to the above-described lock family blank 200, and each of the control key family blanks is substantially similar to the above-described control key family blank 300. Unless indicated otherwise, similar reference characters are used to indicate similar elements and features.

As described in further detail below, each of the lock families 51, 52, 53, 54 includes a plurality of lock cylinder species. For example, the lock family 51 includes lock species 21, 22, and the lock family 52 includes lock species 23, 24. Each lock species includes at least one lock cylinder. For example, the lock species 21 may include the lock cylinder 210, and the lock species 22 may include the lock cylinder 220. Each member of a lock family 51, 52, 53, 54 may be formed from a lock family blank 510, 520, 530, 540 that is unique to the lock family. Each of the lock families 51, 52, 53, 54 may in turn be a member of a lock class 71, 72. Each of the lock family blanks 510, 520, 530, 540 may be formed from a lock class blank 710, 720 unique to the lock class.

Similarly, each of the control key families 61-64 includes a plurality of control key species. For example, the control key family 61 includes the control key species 31, 32, and the control key family 62 includes the control key species 33, 34. Each control key species includes at least one control key. For example, the control key species 31 includes the control key 310, and the control key species 32 includes the control key 320. Each member of a control key family 61, 62, 63, 64 may be formed from a control key family blank 610, 620, 630, 640 unique to the control key family. Each of the control key families 61-64 may in turn be a member of a control key class 81, 82, and each of the control key family blanks 610, 620, 630, 640 may be formed from a control key class blank 810, 820 unique to the control key class. While FIG. 12 depicts classes, families, and species of control keys, it is to be understood that classes, families, and species of change keys may be substantially similar to the corresponding group of control keys, with the exception that the change keys need not include control bittings.

Figure 13:
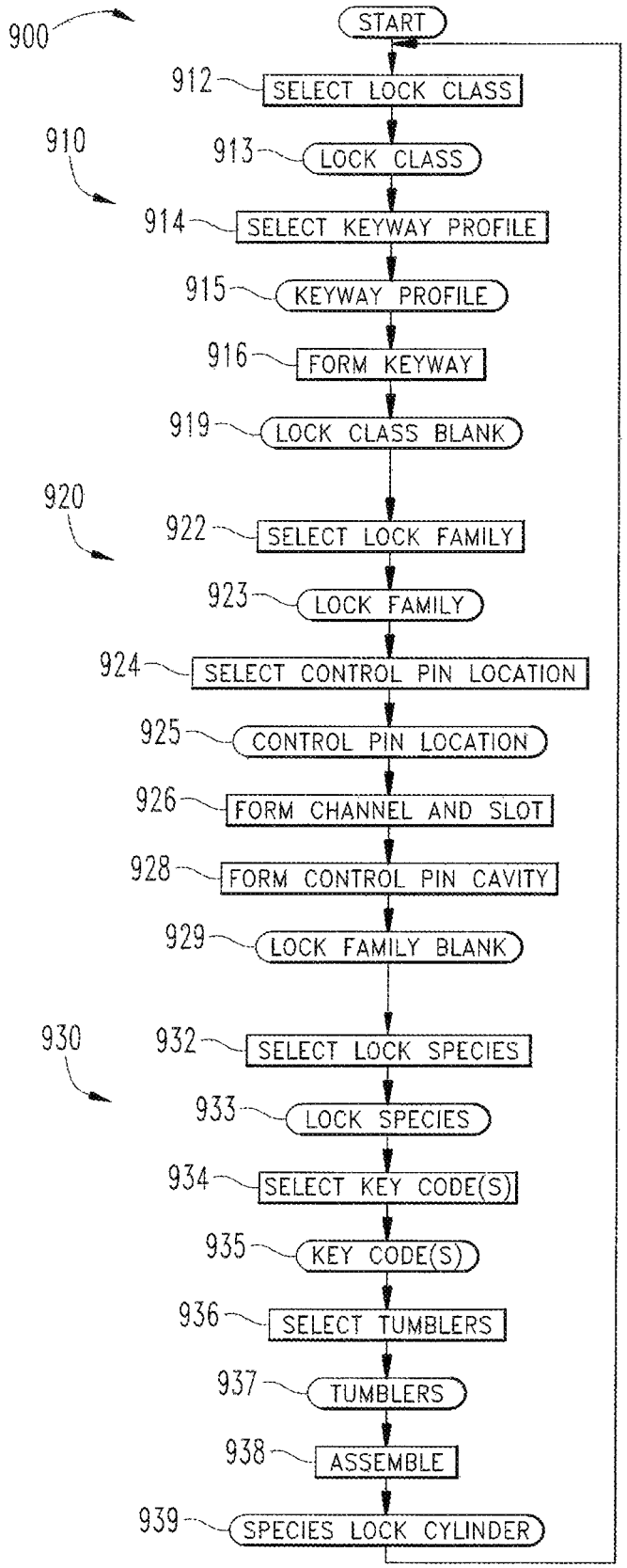
FIG. 13 is a schematic flow diagram of a process for creating lock cylinders according to one embodiment.

With reference to FIG. 13, illustrated therein is an exemplary process 900 which may be performed to create a plurality of lock cylinders from lock cylinder master blanks 500. The process 900 generally includes a procedure 910 for creating a lock class, a procedure 920 for creating a lock family within the lock class, and a procedure 930 for creating a lock species within the lock family. Operations illustrated for the processes in the present application are understood to be exemplary only. Unless explicitly stated to the contrary, operations may be combined or divided, added or removed, and/or re-ordered in whole or in part.

The process 900 may begin with the procedure 910. The procedure 910 may begin with an operation 912 which includes selecting a lock class 913. For example, in a first iteration of the process 900, the selected lock class 913 may be the lock class 71. The procedure 910 may then proceed to an operation 914 which includes selecting a keyway profile 915 for the selected lock class 913. The keyway profile 915 may, for example, be selected from the above-described keyway profiles 421-427.

The procedure 910 may then continue to an operation 916 which includes forming a keyway with the selected keyway profile 915 to create a lock class blank 919 for the selected lock class 913. For example, in the first iteration of the process 900, the lock class blank 919 may be in the form of the lock class blank 710. The operation 916 may include forming the keyway 713 by known techniques such as, for example, by milling or machining the keyway 713 into the plug 502 of the cylinder master blank 500. In certain embodiments, the operation 916 may include forming the entire keyway 713 with the selected keyway profile 915. As described in further detail below, it is also contemplated that the operation 916 may include forming a first portion of the keyway 713 with the selected keyway profile 915, and a second portion of the keyway 713 with a second keyway profile. With the lock class blank 919 formed, the procedure 910 may be repeated to create a plurality of lock class blanks 710 for a single lock class 71, or to create lock class blanks 710, 720 for a plurality of lock classes 71, 72.

The process 900 may then continue to the procedure 920, which includes converting the lock class blank 919 to a lock family blank 929. The procedure 920 may begin with an operation 922 which includes selecting a lock family 923 within the selected lock class 913. For example, in the first iteration of the process 900, the selected lock family 923 may be the lock family 51, and the procedure 920 may convert the lock class blank 710 to the lock family blank 510. With the lock family 923 selected, the procedure 920 may continue to an operation 924 which includes selecting a control pin location 925 for the selected lock family 923.

With the control pin location 925 selected, the procedure 920 may continue to an operation 926 which includes forming a control ring channel (such as the control ring channel 119 depicted in FIG. 1) and a control lug slot (such as the control lug slot 115 depicted in FIG. 3) at the selected control pin location 925. For example, the operation 926 may include milling or machining the control ring channel 519 and control lug slot in the shell 711 of the lock class blank 710, and yielding the shell 511 of the lock family blank 510. The procedure 920 may further include an operation 928 which includes forming the control pin cavity in the plug at the selected control pin location 925 to complete the lock family blank 929. For example, the first iteration of the process 900 may include forming the control pin cavity 517 in the plug 712 of the lock class blank 710, and yielding the plug 512 of the lock family blank 510. With the lock family blank 929 formed, the procedure 920 may be repeated to create a plurality of lock family blanks 510 for a single lock family 51, or to create lock family blanks 510, 520 for a plurality of lock families 51, 52 within a lock class 71.

The process 900 may then continue to the procedure 930, which includes assembling a species lock cylinder 939 from the lock family blank 929. The procedure 930 may begin with an operation 932 which includes selecting a lock species 933 within the selected lock family 923. For example, in the first iteration of the process 900, the selected lock species 933 may be the lock species 21 such that the species lock cylinder 939 is in the form of the lock cylinder 210. The procedure 930 may then continue to an operation 934 which includes selecting one or more bitting codes 935 which will operate the selected lock species 933.

The procedure 930 may continue to an operation 936 which includes selecting a tumbler system 937 corresponding to the selected bitting codes 935. For example, the operation 936 may include selecting the pin tumbler system 214 for the species of the cylinder 210. With the tumbler system 937 selected, the procedure 930 may continue to an operation 938 which includes assembling a species lock cylinder 939 from the lock family blank 929 and the tumbler system 937. For example, the operation 938 may include installing the tumbler system 214 into the lock family blank 510 to form the lock cylinder 210. With the species lock cylinder 939 formed, the procedure 930 may be repeated to create a plurality of lock cylinders 210 for the same lock species 21, or to create lock cylinders 210, 220 for a plurality of lock species 21, 22 within a lock family 51.

Portions or the entirety of the process 900 may be repeated to create a plurality of lock cylinders which may be of varying lock classes, lock families, and lock species. In certain forms, some iterations of the process 900 may include selecting the same keyway profile 915 in the operation 914 and a unique control pin location 925 in the operation 924 to form a plurality of lock families 51, 52 within a single lock class 71. Due to the fact that each lock family in a lock class has the same keyway profile 915, each lock cylinder in a given lock class is operable to accept keys having a corresponding cross-sectional profile.

In other embodiments, some iterations of the process 900 may include selecting a unique keyway profile 915 in the operation 914, while selecting the same control pin location 925 in the operation 924. In such forms, a lock family blank 510 in one lock class 71 may have a control pin 516 at the same location as a lock family blank 530 in another lock class 72. However, due to the different keyway profiles 423, 424 selected for each lock class 71, 72, a control key 310 associated with the lock family 51 of the first lock class 71 may not necessarily be able to enter the keyway of the lock family 53 of the other lock class 72.

Figure 14:
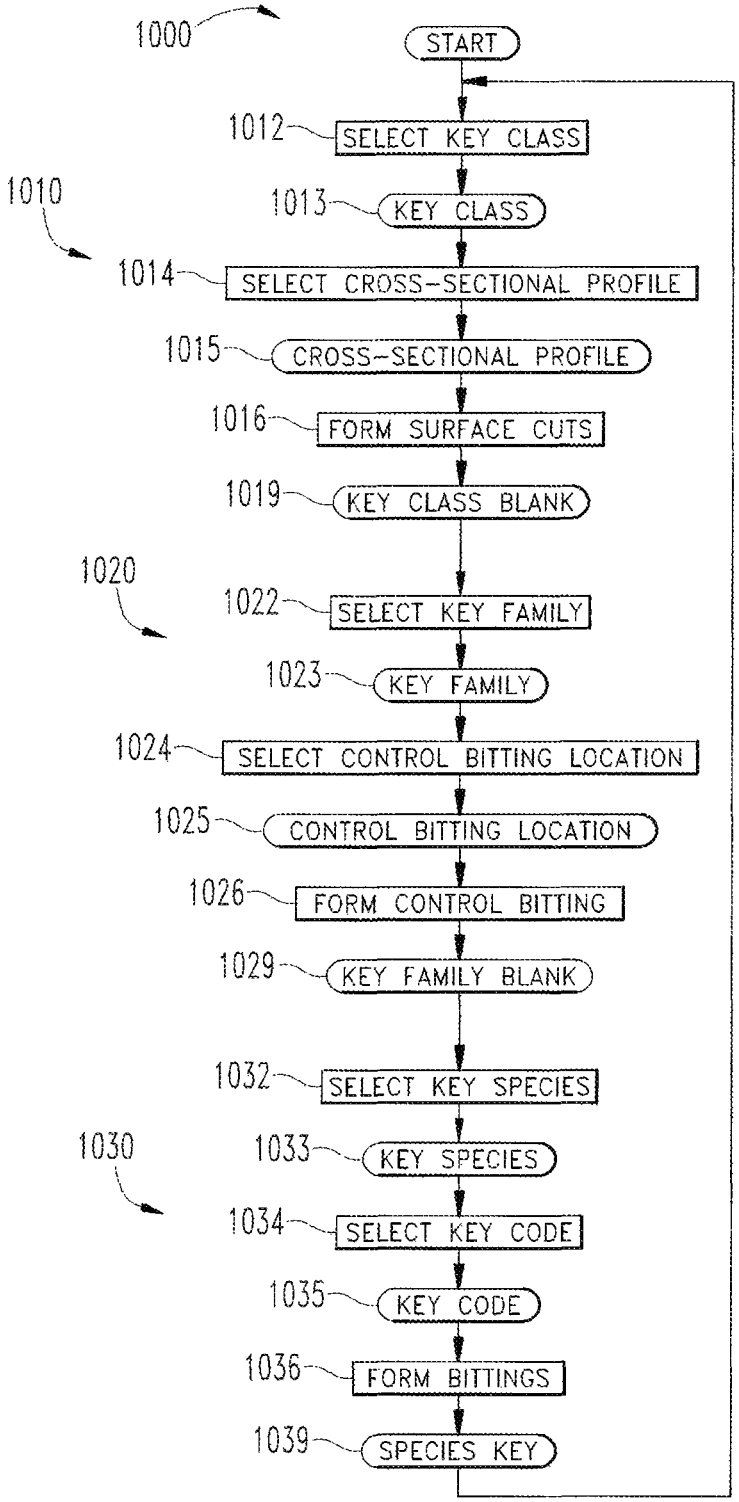
FIG. 14 is a schematic flow diagram of a process for creating keys according to one embodiment.

With reference to FIG. 14, illustrated therein is an exemplary process 1000 which may be performed to create a plurality of keys from a master key blank. The process 1000 generally includes procedure 1010 for creating a control key class, a procedure 1020 for creating a control key family within the control key class, and a procedure 1030 for creating a control key species within the control key family. Operations illustrated for the processes in the present application are understood to be exemplary only. Unless explicitly stated to the contrary, operations may be combined or divided, added or removed, and/or re-ordered in whole or in part.

The process 1000 may begin with the procedure 1010. The procedure 1010 may begin with an operation 1012 which includes selecting a key class 1013. For example, in a first iteration of the process 1000, the selected key class 1013 may be the control key class 81 which corresponds to the lock class 71. The procedure 1010 may then proceed to an operation 1014 which includes selecting a cross-sectional profile 1015 for the selected key class 1013. The cross-sectional profile 1015 may be selected from the cross-sectional profiles of the above-described profile set 430. For example, with the control key class 81 selected, the selected cross-sectional profile 1015 may be the cross-sectional profile 443 which corresponds to the keyway profile 423 of the associated lock class 71.

The procedure 1010 may then continue to an operation 1016 which includes forming a key with the selected cross-sectional profile 1015 to create a key class blank 1019 for the selected key class 1013. For example, in the first iteration of the process 1000, the key class blank 1019 may be the control key class blank 810. The operation 1016 may include forming the surface cut 813 and the cross-sectional profile 1015 by known techniques such as, for example, by milling or machining the side surfaces 603 of the key master blank 600 to form the control key class blank 810. With the surface cut 813 formed in the side surface of the control key class blank 810, the control key class blank 810 includes a ridge 816 which may extend along the length of the shank. With the key class blank 1019 formed, the procedure 1010 may be repeated to create a plurality of control key class blanks 810 for a single control key class 81, or to create control key class blanks 810, 820 for a plurality of control key classes 81, 82.

The process 1000 may then continue to the procedure 1020 which includes converting the key class blank 1019 to a key family blank 1029. The procedure 1020 may begin with an operation 1022 which includes selecting a key family 1023 within the selected key class 1013. For example, in the first iteration of the process 1000, the selected key family 1023 may be the control key family 61, and the procedure 1020 may convert the control key class blank 810 to the control key family blank 610. With the key family 1023 selected, the procedure 1020 may continue to an operation 1024 which includes selecting a control bitting location 1025 for the selected key family 1023. For example, with the control key family 61 selected, the selected control bitting location 1025 may correspond to the control pin location of the associated lock family 51.

With the control bitting location 1025 selected, the procedure 1020 may continue to an operation 1026 which includes forming a control bitting at the selected control bitting location 1025. For example, the operation 1026 may include milling or machining away portions of the ridge 816 which do not correspond to the selected control bitting location 1025. As a result, all that remains of the ridge 816 in the control key family blank 610 is the control bitting 616. With the key family blank 1029 formed, the procedure 1020 may be repeated to create a plurality of control key family blanks 610 for a single control key family 61, or to create control key family blanks 610, 620 for a plurality of control key families 61, 62.

The process 1000 may then continue to the procedure 1030 which includes forming a species key 1039 from the key family blank 1029. The procedure 1030 may begin with an operation 1032 which includes selecting a key species 1033 within the selected key family 1023. For example, in the first iteration of the process 1000, the selected key species 1033 may be the control key species 31 which corresponds to the lock species 21. The procedure 1030 may then continue to an operation 1034 which includes selecting a bitting code 1035 for the selected species 1033. For example, with the control key species 31 selected, the selected bitting code 1035 may be a bitting code which will set the tumbler system 214 of a lock cylinder 210 of the associated lock species 21 to the unlocking position. In embodiments in which the tumbler system 214 of the associated lock cylinder 210 includes one or more master pins, there may be a plurality of bitting codes which will move the tumbler system 214 to the unlocking position.

With the bitting code 1035 selected, the procedure 1030 may continue to an operation 1038 which includes forming a species key 1039 from the key family blank 1029. For example, with the control key species 31 selected, the operation 1038 may include milling or machining bittings 314 into the edge 613 of the control key family blank 610, thereby resulting in a key cut 313 which provides the control key 310 with the root depths corresponding to the bitting code 1035 selected for the control key species 31. With the species key 1039 formed, the procedure 1030 may be repeated to create a plurality of control keys 310 for a single control key species 31, or to create control keys 310, 320 for a plurality of control key species 31, 32.

Portions or the entirety of the process 1000 may be repeated to create a plurality of keys which may be of varying key classes, key families, and key species. In certain forms, iterations of the process 1000 may include selecting the same cross-sectional profile 1015 in the operation 1014 and a unique control bitting location 1025 in the operation 1024 to form a plurality of control key families within a single control key class. Due to the fact that each control key family in a control key class has the same cross-sectional profile 1015, each control key in a given control key class can be utilized with lock cylinders of an associated lock class.

In other embodiments, some iterations of the process 1000 may include selecting a unique cross-sectional profile 1015 in the operation 1014, while selecting the same control bitting location 1025 in the operation 1024. In such forms, control key families in different control key classes may have control bittings at the same location. However, due to the different cross-sectional profiles selected for each control key class, a control key corresponding to a lock family in one lock class may not necessarily be able to enter the keyway of a lock family of another lock class.

It is to be appreciated that, while the process 1000 is described above as creating key classes, key families, and key species for a control key, various operations may be modified or omitted to create key classes, key families, and key species for a change key. For example, once the cross-sectional profile 1015 has been selected in the operation 1014, the operation 1016 may include forming a change key class blank which does not include a ridge such as the ridge 816. Due to the fact that control key family blanks 610, 620 within a control key class 81 differ only in the location of the control bittings 616, 626, the change key family blanks within a change key class may be identical.

With additional reference to FIGS. 9-12, in certain embodiments, the operation 922 may include forming a keyway with a varying keyway profile. For example, in a second iteration of the process 900, the selected lock family 923 may be the lock family 52 in which the control pin location 925 is offset from the distal end of the lock family blank 520. In the associated control key family blank 620, the control bitting 626 is offset from the distal tip 621 of the key. In such forms, the keyway 523 may be formed with the selected keyway profile 915 from the proximal end of the plug 522 to a location distal of the control pin cavity 527. On the distal side of the control pin cavity 527, the keyway 523 may be formed with a ward which prevents insertion of a control key belonging to a key family not associated with the lock family 52. For example, the lock species 23 in the lock family 52 includes a ward 239 on the distal side of the control pin 236. The ward 239 may, for example, prevent a control key 310 of the control key family 61 from being fully inserted into the keyway 233 due to the fact that the control bitting 316 is formed near the tip 311 of the control key 310.

Furthermore, in certain embodiments, various procedures within the processes 900, 1000 may be performed by a single party, or may be distributed among several parties. For example, while assembling a lock cylinder 939 in the procedure 930 is relatively simple, manufacturing lock class blanks 919 in the procedure 910 and/or manufacturing lock family blanks 929 in the procedure 920 may require specialized tools or equipment. As such, the procedures 910, 920 may be performed by a manufacture who may supply the lock family blanks 929 and tumbler systems 937 to a second party. The second party may perform the procedure 930 to create the species lock cylinder 939, and may then sell the lock species to a retailer or end user.

Similarly, forming the bittings in the operation 1036 is relatively simple, and many retail and hardware stores have equipment capable of doing so. Other operations, such as forming the surface cuts to provide a key with a given cross-sectional profile 1015 in the operation 1014 and forming the control bitting at the selected control bitting location 1025 in the operation 1026, may require specialized tools or equipment. In certain embodiments, the procedures 1010, 1020 may be performed by a manufacturer who may supply the key family blanks 1029 to a second party. The second party may perform the procedure 1030 to create the species keys 1039, and may then sell the species keys to a retailer or end user. In other embodiments, the manufacturer may perform only the procedure 1010, and may supply the key class blanks 1019 to the second party. The second party may then perform the procedure 1020 to form key family blanks 1029, and may further perform the procedure 1030 to form species keys 1039.

As noted above, each lock class 71, 72 may have a unique keyway profile 423, 424, and each key class 81, 82 may have a cross-sectional profile 443, 444 corresponding to the keyway profile of the associated lock class 71, 72. Furthermore, each lock family 51, 52 within a lock class 71 may have a unique control pin location, and each control key family 61, 62 within a control key class 81 may have a unique control bitting location corresponding to the control pin location of the associated lock family 51, 52. As such, a control key 310 capable of removing a lock cylinder 210 of one lock family 51 from a cylinder housing may not necessarily be capable of removing a lock cylinder 250 of another lock family 53 from a cylinder housing.

By selecting unique combination of the keyway profile and control pin location for each lock family, and a corresponding cross-sectional profile and control bitting location for each key family, one can ensure that a lock cylinder of a given lock family 51 can only be removed by control keys of the associated key family 61. Furthermore, due to the fact that the positioning of the control pin is not performed by the edge cut, a greater number of unique bitting codes remain available.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

a control key class comprising a plurality of control key families, wherein each of the control key families has a control bitting location, and the control bitting location of each of the control key families within the control key class is different from the control bitting location of another of the control key families within the control key class; and a plurality of control keys, wherein each control key is a member of one of the control key families, and wherein each of the control keys comprises:

an edge and a side surface, the side surface including a surface cut;

the surface cut comprising a control bitting formed at the control bitting location of the control key family of which the control key is a member; and wherein the surface cut does not include a second control bitting formed at the control bitting location of at least one control key family of which the control key is not a member.

2. The system of claim 1, wherein each of the control keys within the control key class defines a cross-sectional profile selected for the control key class.

3. The system of claim 2, further comprising a plurality of the control key classes, and wherein the cross-sectional profile selected for each of the control key classes is different from the cross-sectional profile selected for another of the control key classes.

4. The system of claim 1, wherein the edge of each of the control keys comprises an edge cut corresponding to a bitting code, and wherein the bitting code of each of the control keys within each control key family is different from the bitting code of another of the control keys within the same control key family.

5. The system of claim 1, wherein the edge of at least one of the control keys within each control key family is flat.

6. The system of claim 1, wherein the surface cut consists essentially of the control bitting.

7. A method of creating the system of claim 1, comprising:

selecting, for each of the control key families within the control key class, the control bitting location of the control key family; and forming, for each of the control key families, the plurality of control keys, wherein forming each of the plurality of control keys for each of the control key families comprises:

removing material from a side surface of a master key blank, thereby forming a groove defined in part by a ledge; and removing portions of the ledge which do not correspond to the control bitting location selected for the control key family, thereby forming the control bitting.

8. A system, comprising:

a control key class associated with a lock class including a plurality of lock families, the control key class comprising a plurality of control key families, and wherein each of the control key families is associated with one of the plurality of lock families, wherein each of the control key families has a control bitting location corresponding to a control pin location of the lock family with which the control key family is associated; and a plurality of control keys, wherein each control key is a member of one of the control key families, and wherein each of the control keys comprises:

an edge and a side surface, the side surface including a surface cut; and the surface cut comprising a control bitting formed at the control bitting location of the control key family of which the control key is a member.

9. The system of claim 8, wherein the control bitting location of each of the control key families within the control key class is different from the control bitting location of another of the control key families within the control key class.

10. The system of claim 8, wherein the surface cut does not include a second control bitting formed at the control bitting location of at least one control key family of which the control key is not a member.

11. The system of claim 8, wherein each of the control keys within the control key class defines a cross-sectional profile selected for the control key class.

12. The system of claim 11, further comprising a plurality of the control key classes, and wherein the cross-sectional profile selected for each of the control key classes is different from the cross-sectional profile selected for another of the control key classes.

13. The system of claim 8, wherein the edge of each of the control keys comprises an edge cut corresponding to a bitting code, and wherein the bitting code of each of the control keys within each control key family is different from the bitting code of another of the control keys within the same control key family.

14. The system of claim 13, wherein the bitting code of each of the control keys within each control key family is different from the bitting code of another of the control keys within the same control key family.

15. The system of claim 8, wherein the edge of at least one of the control keys within each control key family is flat.

16. The system of claim 8, wherein the surface cut consists essentially of the control bitting.

17. A system, comprising:

a control key class comprising a plurality of control key families, wherein each of the control key families has a control bitting location, and the control bitting location of each of the control key families within the control key class is different from the control bitting location of another of the control key families within the control key class; and a plurality of control keys, wherein each control key is a member of one of the control key families, and wherein each of the control keys comprises:

an edge and a side surface, the side surface including a surface cut; and the surface cut comprising a control bitting formed at the control bitting location of the control key family of which the control key is a member; and wherein the edge of each of the control keys comprises an edge cut corresponding to a bitting code, and wherein the bitting code of each of the control keys within each control key family is different from the bitting code of another of the control keys within the same control key family.

18. The system of claim 17, wherein the surface cut does not include a second control bitting formed at the control bitting location of at least one control key family of which the control key is not a member.

19. The system of claim 17, wherein each of the control keys within the control key class defines a cross-sectional profile selected for the control key class.

20. The system of claim 19, further comprising a plurality of the control key classes, and wherein the cross-sectional profile selected for each of the control key classes is different from the cross-sectional profile selected for another of the control key classes.

21. The system of claim 1, wherein the edge of each of the plurality of control keys comprises an edge cut corresponding to a bitting code, and wherein the bitting code of each of the plurality of control keys within each control key family is different from the bitting code of another of the plurality of control keys within the same control key family.

22. The system of claim 1, wherein each of the control keys within the control key class defines a cross-sectional profile selected for the control key class; and wherein the system further comprises a plurality of the control key classes, and wherein the cross-sectional profile selected for each of the control key classes is different from the cross-sectional profile selected for another of the control key classes.

* * * * *